United States Patent [19]

Lagache

[11] Patent Number: 4,733,231

[45] Date of Patent: Mar. 22, 1988

[54] SYSTEM FOR DISPLAYING A SEGMENT, PRIMARILY FOR USE IN A REMOTE-CONTROLLED DIGITAL DISPLAY

[75] Inventor: Roland Lagache, Le Canon, France

[73] Assignee: Lafon S.A., Bassens, France

[21] Appl. No.: 734,558

[22] Filed: May 16, 1985

[30] Foreign Application Priority Data

May 23, 1984 [FR] France ..... 84 08007

[51] Int. Cl.[4] ..... G09G 3/20

[52] U.S. Cl. ..... 340/783; 340/815.05

[58] Field of Search ..... 340/783, 763, 764, 815.04, 340/815.05, 815.23, 815.08

[56] References Cited

U.S. PATENT DOCUMENTS

| | | | |
|---|---|---|---|
| 3,581,301 | 5/1971 | Stutz et al. | 340/764 |
| 3,916,403 | 10/1975 | Mandzsu et al. | 340/815.04 |
| 4,117,478 | 9/1978 | Skrobisch | 340/815.04 |
| 4,323,894 | 4/1982 | Wood et al. | 340/764 |
| 4,531,318 | 7/1985 | Chang et al. | 340/815.05 |

FOREIGN PATENT DOCUMENTS

| | | |
|---|---|---|
| 0093600 | 11/1983 | European Pat. Off. . |
| 1429478 | 1/1966 | France . |
| 2379120 | 8/1978 | France . |

*Primary Examiner*—Marshall M. Curtis

*Attorney, Agent, or Firm*—Jones, Day, Reavis & Pogue

[57] ABSTRACT

A system for displaying a segment as applicable in particular to remote-controlled digital display. A control circuit energizes two stationary series-connected electromagnets with pulses of the same polarity so as to produce a magnetic field in each electromagnet. Under the action of the magnetic field, a single permanent magnet rigidly fixed to the segment is capable of displacement between the electromagnets in order to move the segment from a visible active position to a hidden active position.

6 Claims, 3 Drawing Figures

SYSTEM FOR DISPLAYING A SEGMENT, PRIMARILY FOR USE IN A REMOTE-CONTROLLED DIGITAL DISPLAY

BACKGROUND OF THE INVENTION

1. Field of the Invention

The present invention relates to a system for displaying a segment by electromagnets, of the type employed in an automatic and remote-controlled digital display.

2. Description of the Prior Art

Many systems for display by electromagnetic segments are already known. Among these can be mentioned in particular the system comprising two electromagnets in the form of ferrite disks housed within an insulating support, two permanent magnets mounted in series but parallel to each other on each side of a pivot-pin, and a control circuit for energizing the electromagnets in order to produce a magnetic field. As a function of judiciously chosen polarities of the magnets employed, the magnetic field permits rotation of the permanent magnets about the pivot-pin through an angle such that the segment which is rigidly fixed to said pivot-pin can move from a visible active position to a hidden active position. When the segment is brought into one of said positions, its return displacement to the other initial position is obtained by reversing the polarity of the pulses delivered by the control circuit so as to reverse the polarities of the permanent magnets. The assembly is so designed that a magnetic remanence within the electromagnets is necessary in order to maintain the permanent magnets against the electromagnets unless the control circuit is continuously maintained in the energized state, which is not a desirable method for ensuring good reliability, particularly as seven segments and therefore the same number of systems are employed for displaying a digit.

Furthermore, in a system of this type, there are no means of checking whether the segment is actually in one of the two active positions mentioned above. Should the segment occupy an indeterminate position for any reason, it is not easy in such a case for the user to know whether the segment is hidden or whether an incident has occurred.

SUMMARY OF THE INVENTION

The aim of the present invention is to overcome the disadvantages mentioned in the foregoing and to propose a system which has a very simple structural design and is highly reliable while being inexpensive to produce.

The invention is accordingly directed to a system for displaying a segment of the type comprising two stationary electromagnets mounted in series and supplied with voltage from an electric control unit in order to produce a magnetic field within each electromagnet aforesaid, and a permanent magnet rigidly fixed to the segment and capable under the action of the magnetic field produced of moving between said electromagnets in order to bring said segment from a visible active position to a hidden active position. The system is distinguished by the fact that said segment is associated with a single permanent magnet and that the electric control unit energizes the electromagnets with pulses of the same polarity.

The particular structure of a single permanent magnet and of an electric control unit for delivering pulses having the same polarity makes it possible to simplify the system and to reduce the power consumption.

In accordance with another distinctive feature, the system comprises means for checking the position of the segment between its two active positions in order to permit detection of an incident in the system.

BRIEF DESCRIPTION OF THE DRAWINGS

Other features of the invention will be more apparent upon consideration of the following description and accompanying drawings, wherein.

DESCRIPTION OF THE PREFERRED EMBODIMENTS

Figure 1:
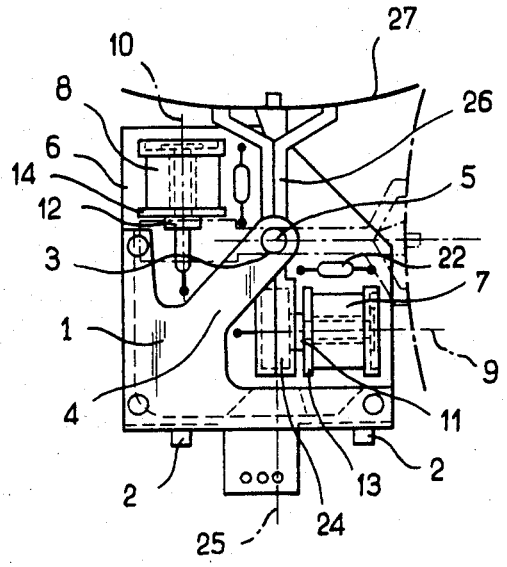
FIG. 1 is a view in elevation showing the system in accordance with the invention.

The system in accordance with the invention comprises a mounting support 1 which is fixed on a general base (not shown in the drawings) and designed to receive the seven systems which are necessary for display of a digit. It is in fact already known that each digit to be displayed is composed of seven segments which are controlled separately by a system hereinafter described in detail, in such a manner as to ensure that the combination or more precisely the display of a predetermined number of digits produces the desired digit.

The mounting support 1 is positioned on the base by means of four studs 2 and fixed by means of a screw (not shown). A stationary shaft 5 which serves as a pivot-pin is introduced within holes 3 formed in extensions 4 of the support 1.

Figure 2:
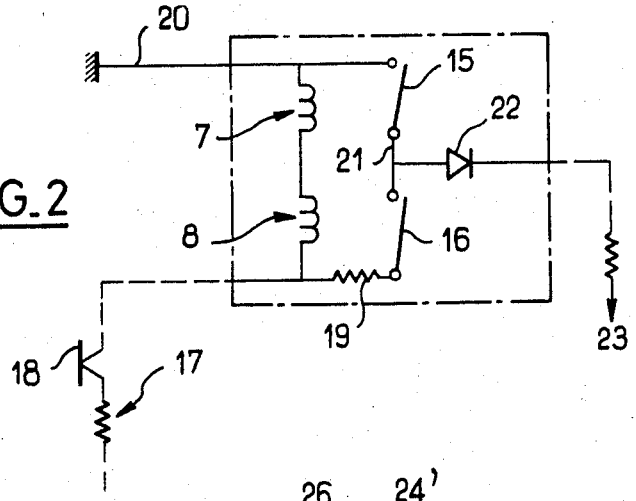
FIG. 2 is a schematic and simplified representation of the electric circuit associated with the system.

A printed circuit 6 is also mounted on the support 1. The printed circuit 6 comprises two electromagnets 7 and 8 in which the axes 9 and 10 of the cores 11, 12 are located at right angles to each other. Each electromagnet 7, 8 has a core 11, 12 consisting of a steel rod which is press-fitted on the electromagnet body 13, 14 in such a manner as to guard against the production of magnetic remanence when an electric current no longer passes through the windings of said electromagnets which are mounted in series. Two circuit-breakers 15 and 16 such as leaf-spring switches are mounted in series with each other and in parallel with the two electromagnets 7, 8. The circuit-breakers 15 and 16 are also connected to a control circuit 17 which is illustrated very diagrammatically in FIG. 2 and comprises a transistor 18 which, in the conducting state, always delivers pulses having the same polarity and of short duration of the order of 50 ms. A resistor 19 having a suitable value is mounted between the circuit-breaker 16 and the control circuit 17 and constitutes a voltage-dropping element. A line 20 connects one end of the winding of the electromagnet 7 as well as one end of the circuit-breaker 15 to ground. In consequence, a positive voltage (48 V, for example) is generated at the output of the transistor 18 at each changeover of the transistor to the conducting state. A diode 22 is connected to the common line 21 of two circuit-breakers 15 and 16 and the output of said diode is connected to a measuring device 23.

A permanent magnet 24 is mounted between the two electromagnets 7 and 8 in such a manner as to ensure that, when said magnet 24 is applied against one of said electromagnets 7, 8, its axis 25 is perpendicular to the axes 9, 10. To this end, in the example illustrated in the drawings, the permanent magnet is rigidly fixed to an arm 26 which serves to support a segment 27. The segment 27 can be mounted on the arm 26 by making use of any suitable means such as locking recesses (not shown in the drawings). The assembly formed by the arm 26 and the body of the permanent magnet 24 is capable of rotating about the stationary shaft 5 as will be described in connection with the operation of the system.

When the control circuit 17 is activated and delivers pulses, the flow of current within the coils of the electromagnets 7 and 8 produces a magnetic field. If the polarities of the electromagnets 7, 8 and of the magnet 24 have been correctly chosen, for example with oppositely-facing north poles in the case of the electromagnet 7 and the permanent magnet 24, a repulsion phenomenon occurs and the permanent magnet 24 is driven towards the left at a predetermined velocity, the circuit-breaker 16 being open and the circuit-breaker 15 being closed. The control circuit is inhibited as soon as repulsion is initiated. The permanent magnet 24 continues its movement of travel by virtue of its initial velocity and is applied against the south pole of the electromagnet 8. Since current does not flow any longer through the electromagnet, this latter performs the function of an iron member against which the south pole of the permanent magnet 24 is maintained. During the movement of the electromagnet 24, the segment 27 which is rigidly fixed thereto rotates through the same angle of rotation (such as 90° in the example considered) and moves from the normal active position in which it is visible and shown in full lines to another normal active position in which it is hidden and shown in chain-dotted lines. The measuring device 23 measures the output voltage of the diode 22 which, by reason of the opening of the circuit-breaker 16, is equal to 48 V, subject to losses within the windings of the electromagnets 7 and 8.

When the circuit 17 is again controlled and other short pulses having the same polarity as the preceding pulses pass through the electromagnets 7 and 8 whilst the circuit-breaker 15 is open and the circuit-breaker 16 is closed, a repulsive force is developed between the oppositely-facing south poles of the electromagnet 8 and of the permanent magnet 24. Similarly, after the permanent magnet has acquired a predetermined initial velocity, the control circuit 17 is stopped, the permanent magnet 24 continues its displacement towards the electromagnet 7, is applied against this latter and remains in this position until the next control operation takes place. During the displacement of the permanent magnet 24, the segment 27 then moves from the position shown in chain-dotted lines to the position shown in full lines in FIG. 1. The measuring device 23 again measures the output voltage of the diode 22. In this position of the segment 27 and depending on the value of the resistor 19, said diode output voltage is equal to 24 V, for example.

Thus, according to the value of the voltage measured at the output of the diode 22, there is every assurance that the segment is in fact located in one of its normal active positions.

If for any reason the segment 24 were to take up an indeterminate position between its normal positions, then in that case the measured voltage at the output of the diode 22 would be different from the previous values and would in all likelihood be zero. Under these conditions, it would be known that an incident has occurred and that remedial action would be necessary. As will readily be apparent, an optical and/or sound alarm can be associated with the measuring device 23 in order to warn the operator that an incident has occurred.

In the example illustrated in the drawings, reference has been made to a system comprising circuit-breakers 15, 16, each of which is associated with an electromagnet 7, 8. These circuit-breakers in fact ensure electrical continuity between the control circuit 17 and the diode 22. It would be equally feasible to contemplate another form of electrical continuity. For example, it is possible to cover the permanent magnet with conductive material which would be connected directly to the control circuit. In the position of application against one of the electromagnets, electrical continuity is ensured by the core of said electromagnet. So far as the resistor 19 is concerned, this resistor would be placed between the diode 22 and one end of a winding of one of the electromagnets in order to produce a voltage drop and to permit the same measurements as before.

Figure 3:
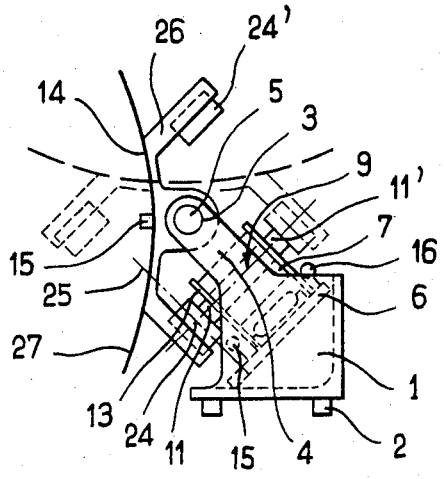
FIG. 3 is a representation of the system in accordance with another embodiment.

In another embodiment shown in FIG. 3, the system comprises a single electromagnet 7, the axis 9 of which is located at right angles to the pivot-pin 5, and two permanent magnets 24, 24' which are rigidly fixed to the segment 27. The permanent magnets 24, 24' are mounted on each side of the pivot-pin 5 in such a manner as to ensure that, when the electromagnet 7 is energized, one of said permanent magnets such as the magnet 24', for example, is applied against one end of said electromagnet 7 in an active position of the segment 27. When the electromagnet 7 is again energized, the permanet magnet 24' is repelled, thereby moving the other permanent magnet 24 into position against the other end of said electromagnet 7. As will be wholly apparent, the polarities of the permanent magnets 24 and 24' as well as those of the electromagnet 7 must be chosen so as to obtain repulsions at each excitation of the electromagnet 7 as is in any case explained in connection with the embodiment of FIG. 1. In one form of construction, the axis 9 of the electromagnet 7 is inclined at 45° to the horizontal in order to permit simple mounting of the permanent magnets 24, 24' on the segment 27, the elements just mentioned being shown in FIG. 3 in full lines in one active position and in dashed lines in the other active position.

It should be clearly understood that the invention is not limited in any sense to the embodiments described and illustrated in the accompanying drawings. Depending on the applications which may be contemplated, consideration may accordingly be given to many alternative forms of construction within the capacity of those versed in the art without thereby departing either from the scope or the spirit of the invention.

What is claimed is:

1. A system for displaying a display segment comprising a support having mounting means extending therefrom, a shaft, serving as a pivot pin, fixed in said support, a relatively thin display segment having a display face for displaying a portion of a character and rotatably mounted on said fixed shaft between two positions one constituting a display position and the other a retracted position, a pair of permanent magnets carried by the display segment on the face thereof opposite the display face, each of said permanent magnets mounted on opposite sides of said fixed shaft near an end of said display segment, electromagnet means of a very low remanence having a core extending perpendicular to the axis of said fixed shaft so that one of said permanent magnets or the other of said permanent magnets may be in contact with an end of said core at any one time, and control means for supplying spaced electrical pulses to said electromagnet whereby the permanent magnet in contact with said one end of said core of said electromagnet means is repelled from said one end causing the other permanent magnet to move toward the other end of said core of said electromagnet means.

2. A system according to claim 1, wherein said control means comprises a transistor connected to an end of said electromagnet means, a control circuit connected to said transistor and intermittently controlling the display means and a pair of switches mounted in series with each other and in parallel to said electromagnet means, said switches each having a closed position corresponding to one of said positions of said display segment.

3. A system according to claim 2, wherein said control means further comprises a voltage-dropping element interposed between said transistor and one of said switches.

4. A system according to claim 2, wherein a diode is connected to a common point between said switches and provides the output of a voltage-measuring means.

5. A system according to claim 4, wherein a substantially zero voltage at the output of the diode corresponds to an intermediate position of said display segment between said positions thereof.

6. A system according to claim 4, wherein permanent magnets are covered with a conductive material connected to said control means whereby said conductive material forms a portion of said switches in order to provide electrical continuity through said electromagnet means between said control means and said voltage measuring means for checking correct positioning of said display segment.

* * * * *